US007294022B1

(12) United States Patent
Cheng

(10) Patent No.: US 7,294,022 B1
(45) Date of Patent: Nov. 13, 2007

(54) VEHICLE POWER PLUG WITH A CONTROL SWITCH

(75) Inventor: Hsu-Cheng Cheng, Tucheng (TW)

(73) Assignee: Tang Yang Dies Co., Ltd., Taipei (TW)

( * ) Notice: Subject to any disclaimer, the term of this patent is extended or adjusted under 35 U.S.C. 154(b) by 0 days.

(21) Appl. No.: 11/605,439

(22) Filed: Nov. 29, 2006

(30) Foreign Application Priority Data

Jan. 3, 2006 (TW) ..... 95200092 U

(51) Int. Cl.
*H01R 24/04* (2006.01)

(52) U.S. Cl. ..... 439/668; 439/675; 200/530

(58) Field of Classification Search ..... 439/668, 439/669, 265, 675; 200/540, 530
See application file for complete search history.

(56) References Cited

U.S. PATENT DOCUMENTS 5,431,585 A * 7/1995 Fan ..... 439/668
5,569,053 A * 10/1996 Nelson et al. ..... 439/668
5,704,812 A * 1/1998 Moji ..... 439/668
5,964,623 A * 10/1999 Maher et al. ..... 439/668

* cited by examiner

*Primary Examiner*—Hae Moon Hyeon
(74) *Attorney, Agent, or Firm*—Troxell Law Office, PLLC

(57) ABSTRACT

The present invention relates to a vehicle power plug with a control switch, comprising a body formed by two mating semi-circular arc covers; an electrode set having a positive pole and a negative pole; and a control switch having a press rod axially connected with an conductive blade, wherein a snappingly engaged structure is disposed in the body with two conductive blade clamps arranged on its two sides, respectively, one blade clamp being coupled with the positive pole, and the other blade clamp and the negative pole being coupled with a power cord, respectively, and then extending out of the body through line holes; consequently, the press rod extending out of a button hole of the body is applied with a force on its one end, and the locating structure longitudinally displaces in the snappingly engaged structure of the body to be selectively located, so as to render the conductive blade contact with or separate from the two conductive blade clamps and thus to control the connection or disconnection with power supply.

9 Claims, 8 Drawing Sheets

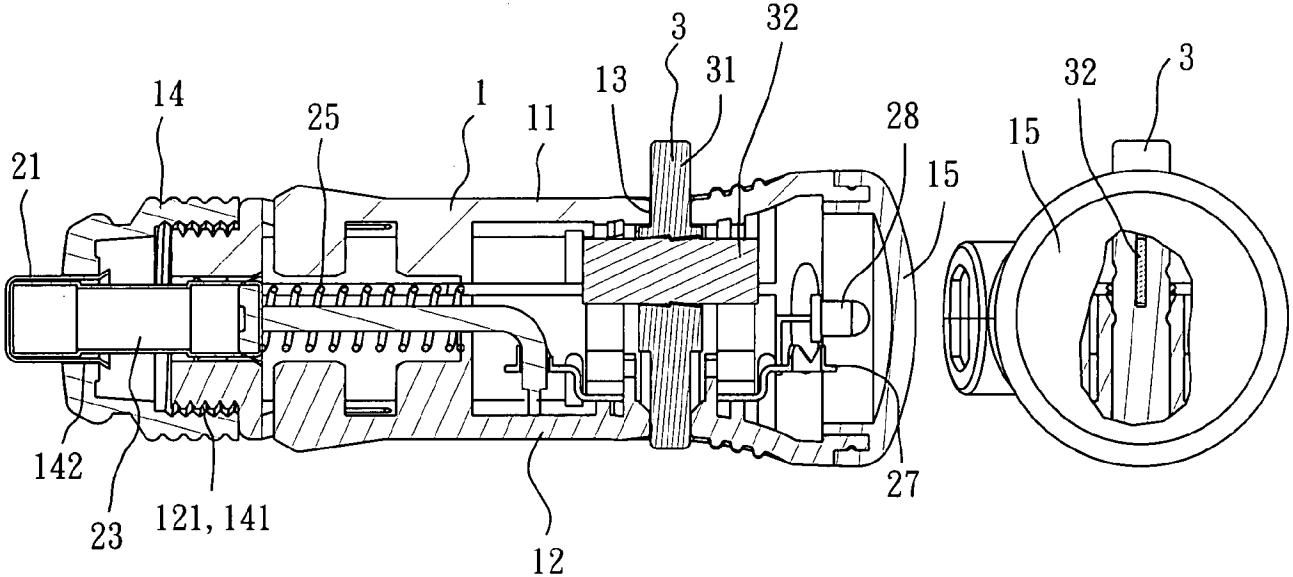
FIG. 4c
FIG. 4a
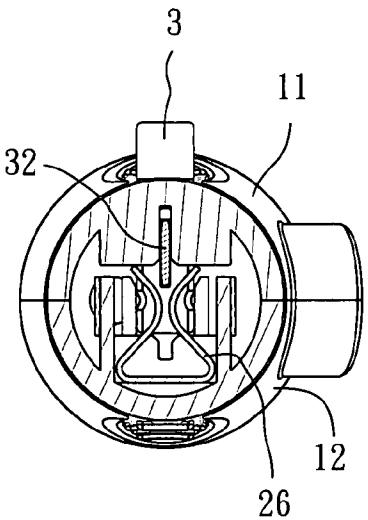
FIG. 4b

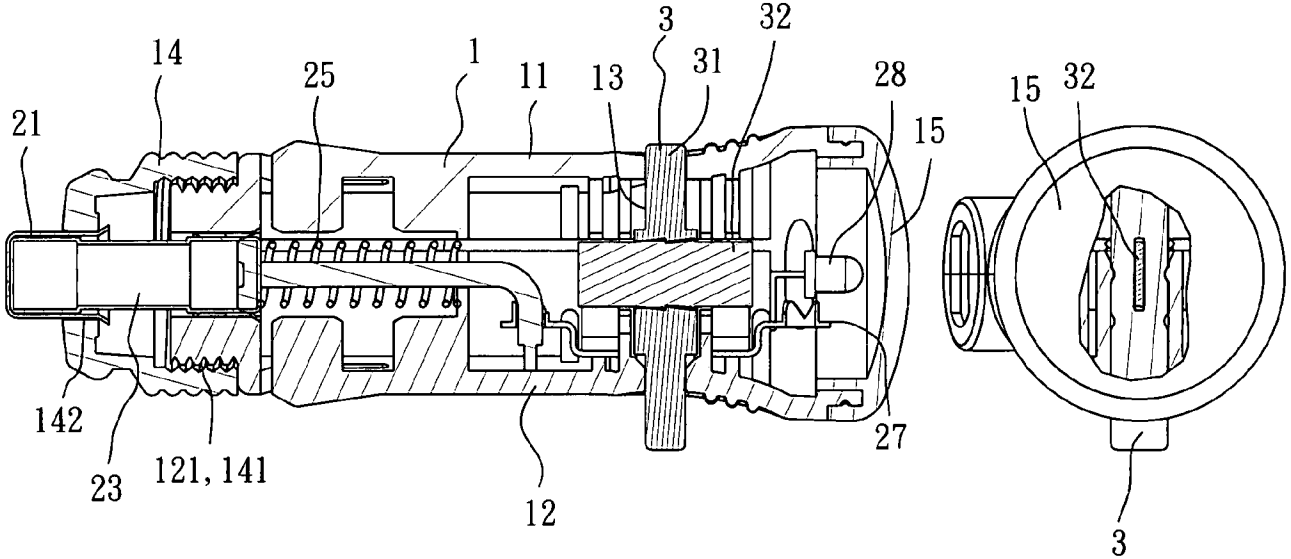
FIG. 7c
FIG. 7a
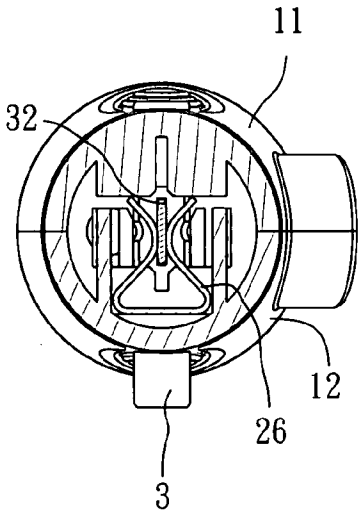
FIG. 7b

VEHICLE POWER PLUG WITH A CONTROL SWITCH

FIELD OF THE INVENTION

The present invention relates to a vehicle power plug and in particular to a vehicle power plug with a control switch.

BACKGROUND OF THE INVENTION

Power plug has been a basic equipment in a car for many years. With increasing demand from drivers and passengers, many devices requiring power supply, including an audio, mobile phone, and so on, have been in great use, apart from the conventional cigarette lighter. Consequently, the demand of power plug is increased and its usage has been greatly enhanced.

The power plug (i.e. widely known as a cigar or cigarette lighter) is disposed with a protruding electrode from its center and the other electrode on its both sides or its circumference, both of which are connected with the respective pole in the cigarette lighter to form a closed circuit. The power is usually a direct current of 12V.

The conventional power plug as described above has a centrally protruding electrode and the other electrode comprising two outward stretching spring plate on the respective side of the power plug; other portion is made of electrically insulating material. Leads are then used to connect the power plug with peripheral devices, such as CD player, mobile recharging seat, and so on.

In order to control the connection/disconnection for the power of the peripheral devices, some companies have installed a switch on the positive pole, a unitary push-on switch with modular design. Although the push-on switch may achieve the expected connection/disconnection function for the power supply, the ampere supplied by the power switch is low, 3 to 5 amperes for example, due to its structural factors. Such a low current is usually not enough to supply certain peripheral devices, such that this kind of power plug cannot be widely applied. Furthermore, this unitary push-on switch is usually manufactured by professional manufacturers with a high price tag, leading to a mounting cost for the power plug manufactures and thus a decreased profit for them. These two factors have posed a great barrier for the wide application of the vehicle power plug.

Consequently, it is necessary to design a new power plug to overcome the drawbacks described above.

SUMMARY OF THE INVENTION

To meet such a demand, the applicant having a long time experience in designing, production, and marketing of the power plug and cigarette lighter proposes the present invention, the vehicle power plug with a control switch, as a result of numerous trials and experiments.

An object of the present invention is to provide a vehicle power plug with a control switch, comprising a hollow cylinder body having two mating semi-circular arc covers with one end sealed by an end cap and the other end socketedly connected to an seal cap, a snappingly engaged structure disposed therein, and a through line hole at an appropriate position running through its top and bottom; an electrode set disposed inside the body having a positive pole and at least two negative poles which are axially and radially disposed, respectively, and protrude from the cover hole of the end cap and at least two opposite slots on the body, respectively, and two conductive blade clamps separately arranged on its two sides the snappingly engaged structure, one blade clamp being coupled with the positive pole and the other blade clamp and the negative pole being coupled with a power cord, respectively, and then extending out of the body through line holes; a control switch having a press rod axially connected with an conductive blade, and the press rod connected with the snappingly engaged structure being machined to form a two-step locating structure with its one end extending out of the body through a button hole; consequently, the press rod extending out of a button hole of the body is applied with a force on its one end and the locating structure longitudinally displaces in the snappingly engaged structure of the body to be selectively located, so as to render the conductive blade contact with or separate from the two conductive blade clamps and thus to control the connection or disconnection with power supply.

Another object of the present invention is to provide a vehicle power plug with a control switch, wherein a fuse is disposed between the positive pole and the positive lead, the positive lead being encompassingly connected within a spring and the rear side of the positive lead extending over a partition rib to couple with a conductive blade clamp.

Yet another object of the present invention is to provide a vehicle power plug with a control switch, wherein the snappingly engaged structure comprises a pair of clamp tenon protrudingly disposed in the body and a pair of snapping rib protrudingly provided in the inner surface of the body corresponding to the clamp tenons, and the locating structure comprises two snapping slots longitudinally formed in the middle section of the press rod so as to render the two snapping ribs selectively snappingly engaged with the snapping slots by the longitudinally displacement of the press rod.

Still yet another of the present invention is to provide a vehicle power plug with a control switch, wherein the positive pole and the negative pole are coupled with a display device to display the power status, and furthermore the display device is a LED light.

Still another of the present invention is to provide a vehicle power plug with a control switch, wherein the each arc cover is provided with an indented screw segment and two clamp edges on its respective end, such that the two covers may be screwed together by an end cap with an internal screw segment and socketingly connected with a seal cap whose circumference provided with a protruding ring. Furthermore, the seal cap is a lens and the two conductive blade clamps are a shape of X with a gap between them.

BRIEF DESCRIPTION OF THE DRAWINGS

The present invention can be more fully understood by reference to the following description and accompanying drawings, in which:

FIGS. 4*a* to 4*c* schematically illustrate the sectional assembly view of the present invention in an open circuit condition;

FIGS. 7*a* to 7*c* schematically illustrate the sectional assembly view of the present invention in a closed circuit condition.

DETAILED DESCRIPTION OF THE INVENTION

Figure 1:
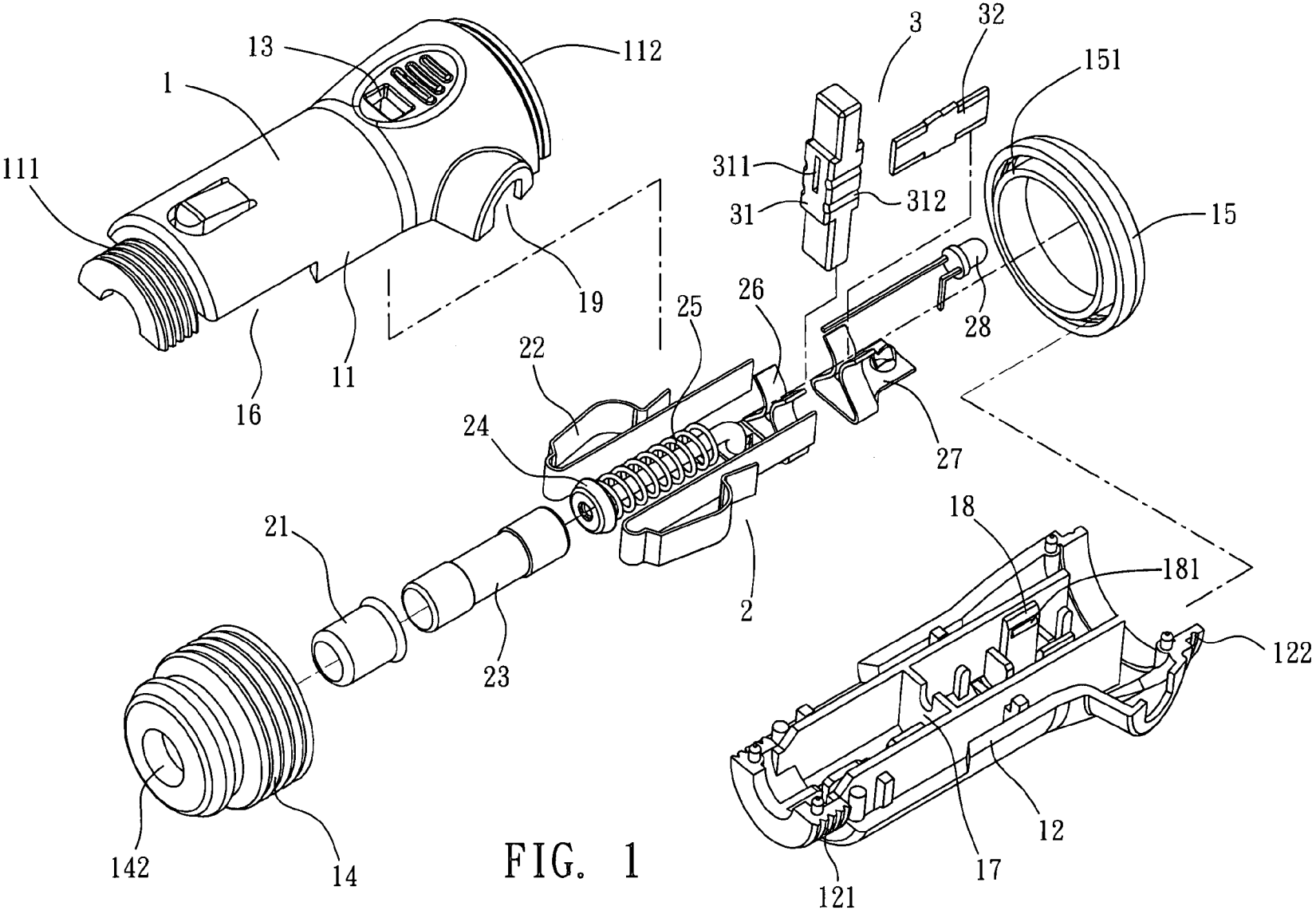
FIG. 1 schematically illustrates the exploded perspective view of a vehicle power plug according to the present invention.
Figure 2:
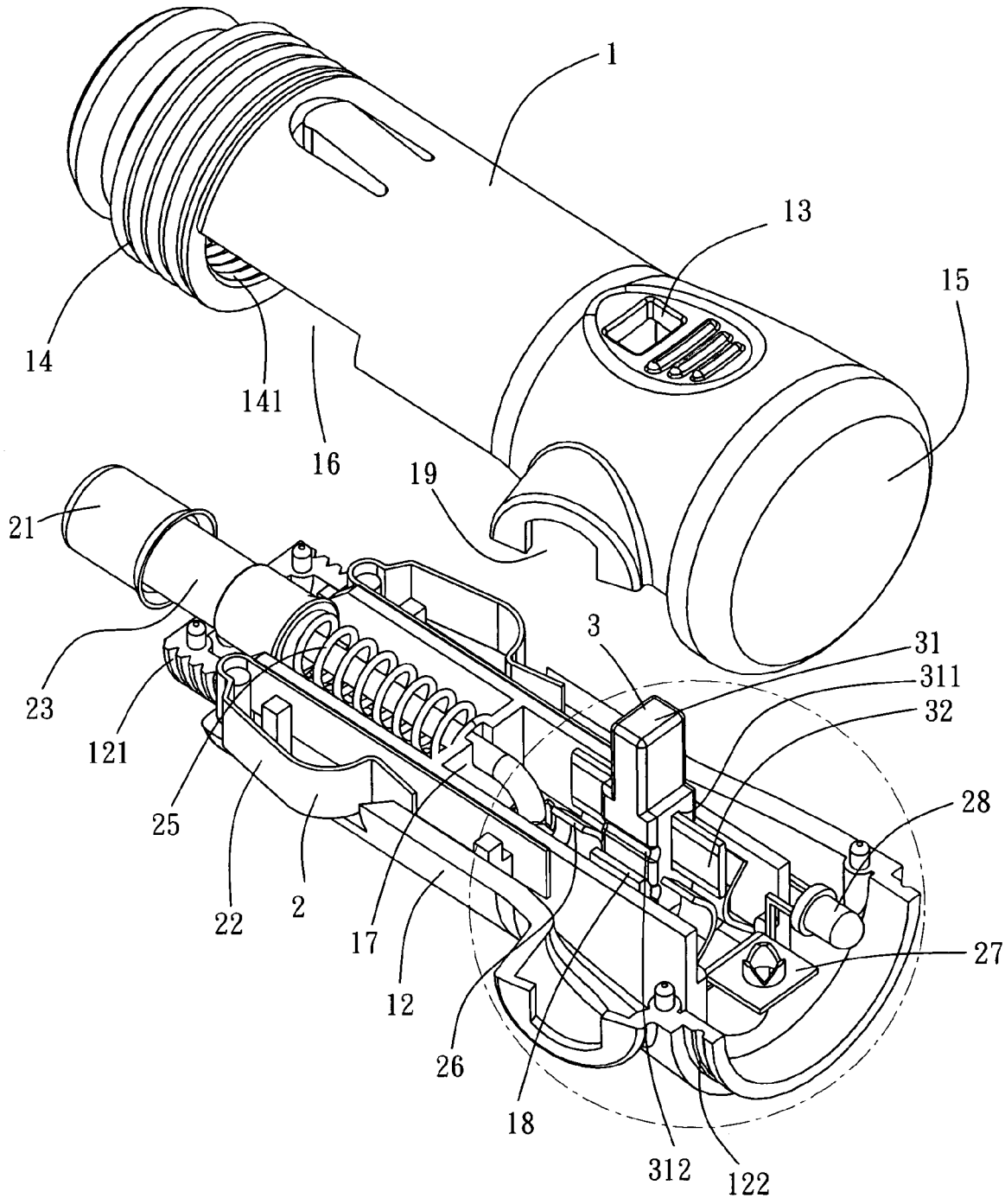
FIG. 2 schematically illustrates the perspective view of a vehicle power plug according to the present invention in an open circuit condition.
Figure 3:
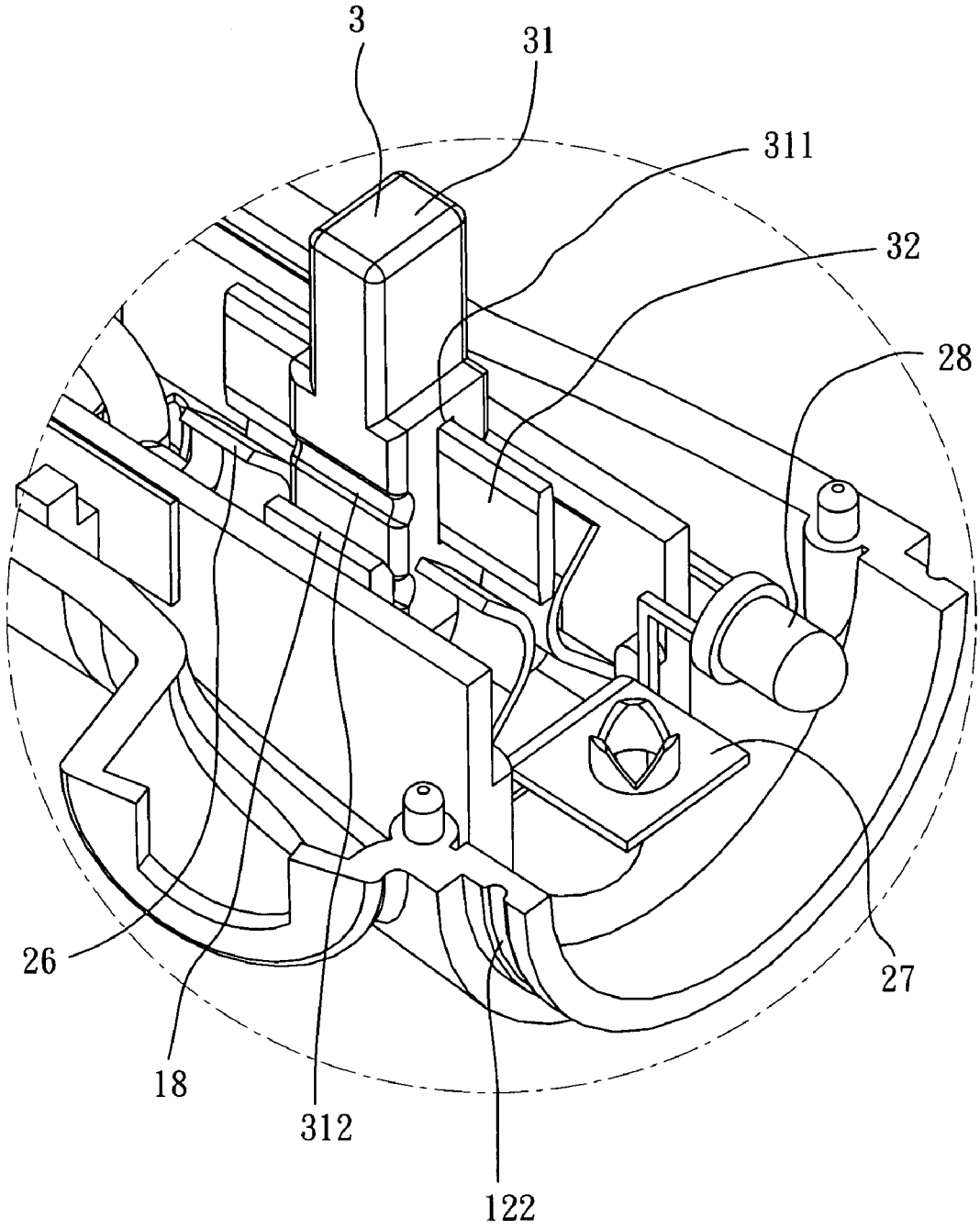
FIG. 3 is partial enlargement view of the perspective view of FIG. 2.
Figure 5:
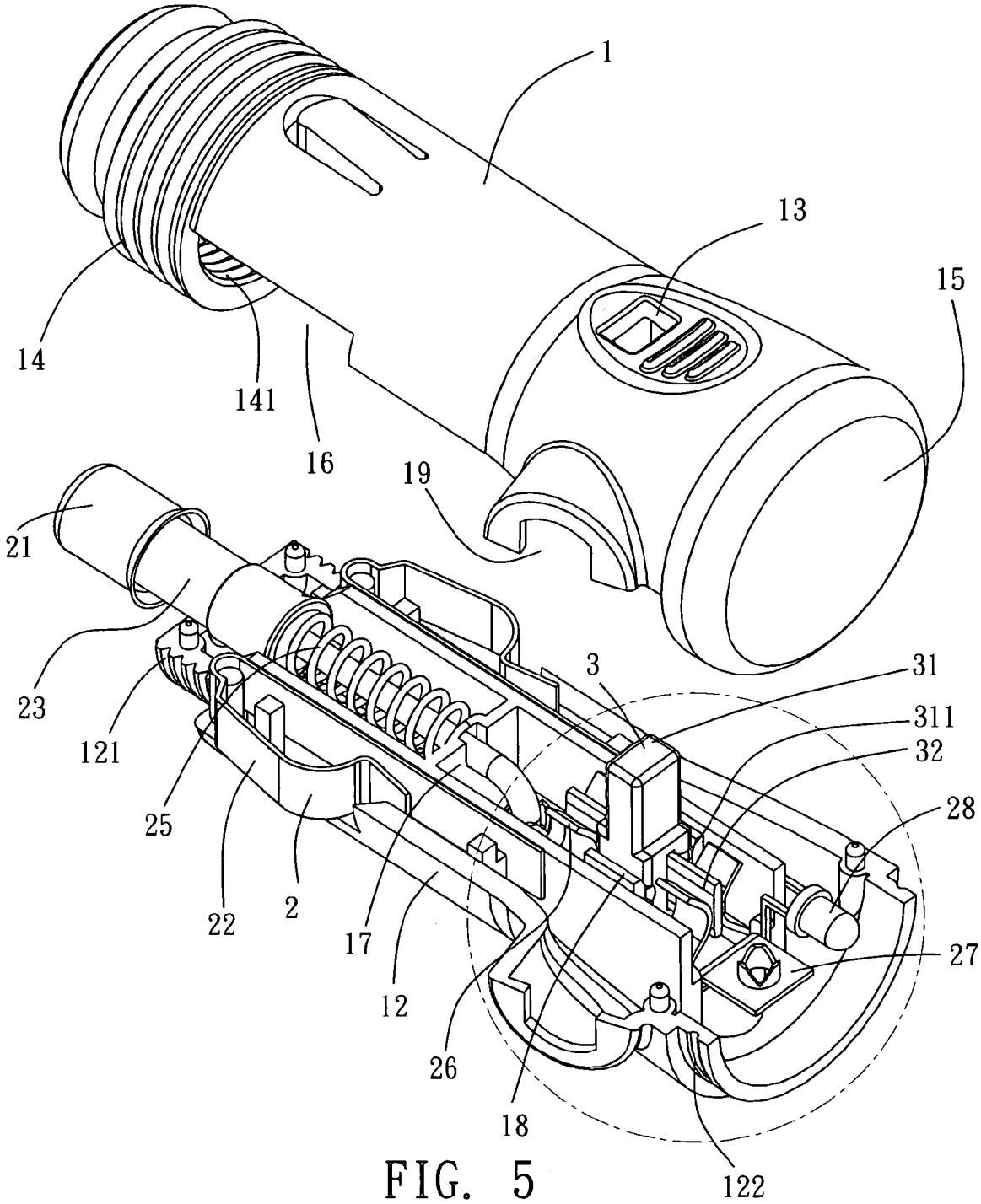
FIG. 5 schematically illustrates the perspective view of a vehicle power plug according to the present invention in a closed circuit condition.
Figure 6:
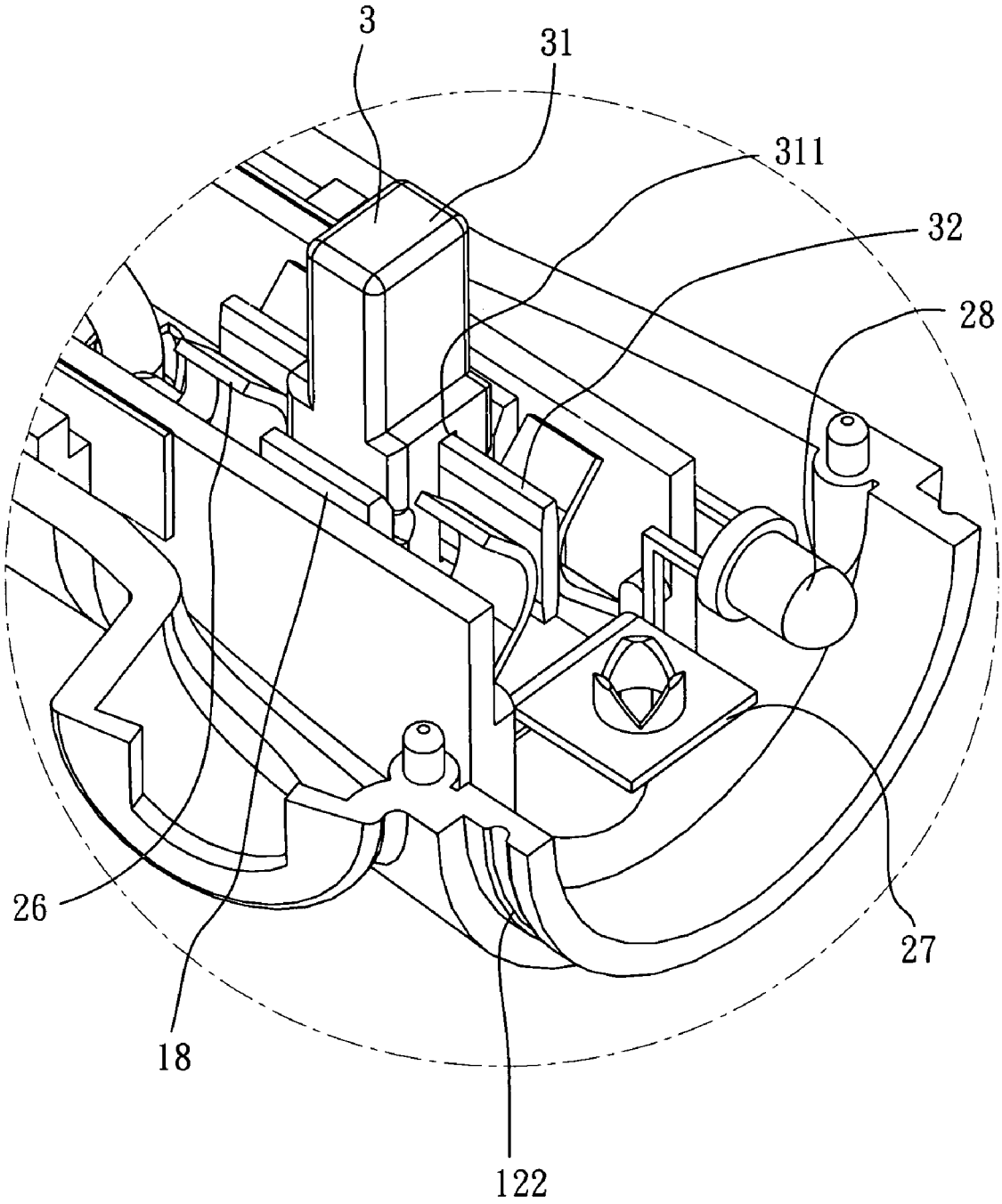
FIG. 6 is partial enlargement view of the perspective view of FIG. 5.

A vehicle power plug according to the present invention, as shown in FIG. 1, comprises a body 1, an electrode set 2, and a control switch 3.

The body 1 is a hollow cylinder comprising two mating semi-circular arc covers 11 and 12, and an end cap 14 is provided to seal one end of the body 1 such that the body 1 may fittingly inserted into the vehicle cigarette socket. The other end of the body 1 is socketingly connected with a seal cap 15, a lens for example, to facilitate the light emission. The arc covers 11 and 12 are provided with indented screw segments 111 and 121 and clamp edges 112 and 122, respectively, such that the two covers 11 and 12 may be screwed together by an internal screw segment 141 of an end cap 14 with and a seal cap 15 whose circumference is provided with a protruding ring 151.

The electrode set 2 comprises an elastic positive pole 21 and at least two negative poles 22, which are axially and radially disposed in the body 1, respectively, and protrude from the cover hole 142 of the end cap 14 and at least two opposite slots 16, respectively. The electrode set 2 may be therefore fittingly inserted into the vehicle cigarette lighter socket to acquire direct current from the positive pole 21 and the negative pole 22, which is a conventional art and thus will not be discussed further. A fuse 23, as shown in FIG. 1, is disposed between the positive pole 21 and the positive lead 24 which is encompassingly connected within a spring 25. The rear end of the positive lead 24 extends over the partition rib 17 in the body 1 to couple with a front conductive blade clamp 26 fixedly disposed on the bottom of the arc cover 12. A snappingly engaged structure, a clamp tenon 18 perpendicularly provided with two opposite snapping rib 181 in its internal surface, for example, is disposed adjacently to the front blade clamp 26; the other rear conductive blade clamp 27 is disposed adjacent to the rear end of the clamp tenon 18, wherein the two conductive blade clamps 26 and 27 are a shape of X with a gap between them. Because they are separately arranged, it is in an open circuit condition.

Furthermore, to provide power to the peripheral devices, the conductive blade clamp 27 and the negative pole 22 are coupled with a power cord (conventional art, not shown), respectively, extending through a line hole 19 of the body 1.

Furthermore, a display device 28, LED light for example, disposed in the seal cap 15 is coupled with the rear conductive blade clamp 27 and the negative pole 22 by its two poles. When the control switch 3 is in a closed circuit condition, the display device 28 will be on to show the power supply is connected.

The control switch 3 comprises a press rod 31 and a conductive blade 32 axially connected with the press rod 31. The press rod 31 is machined to form a plate slot 311 on the middle section of its one side to socketingly connect with the conductive blade 32 and the two adjacent sides are machined to form a two-step locating structure, a two snapping slots 312 for example. Then, the press rod 31 is snappingly engaged with between the two clamp tenons 18 such that the lower snapping slot 312 is snappingly engaged with the snapping rib 181 to render the conductive blade 32 unable to move to between the two conductive blade clamps 26 and 27 and thus an open circuit is resulted. To facilitate an intuitive operation, a button hole 13 is machined to form on the top and bottom of the body 1 corresponding to the two clamp tenons 18, such the end of press rod 31 will protrude the button hole 13 on the top or the bottom.

Figure 8:
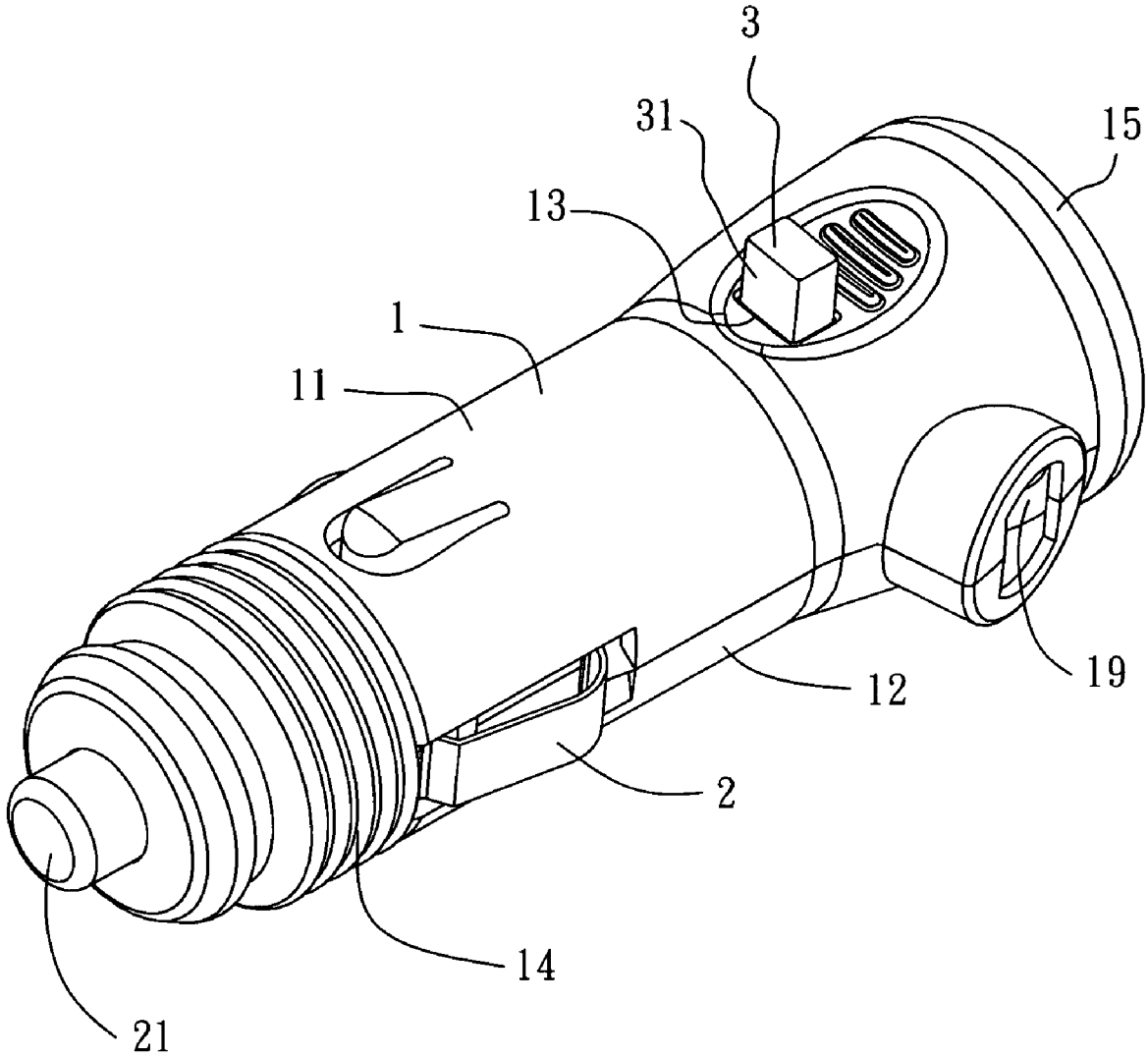
FIG. 8 schematically illustrates the perspective assembly view of the present invention.

With the descriptions of the components and their connections described above, the perspective assembly view of the present invention is shown in FIG. 8.

When the present invention is being operated, please refer to FIGS. 2 to 4*c*.

When the button hole 13 on the bottom of the body 1 is pushed upward, the two clamp tenons 18 move away from the upper snapping slot 312 and thus expand outward due to their spring force until the lower snapping slot 312 moves to the position to snappingly engage with the snapping rib 181. In the mean time, the conductive blade 32 moves upward to leave the two conductive blade clamps 26 and 27, such that the positive pole forms an open circuit to disconnect with the power supply.

As shown in FIGS. 5 to 7*c*, when the button 13 on the top of the body 1 is pushed downward, the two clamp tenons 18 move away from the lower snapping slot 312 and thus expand outward due to their spring force until the upper snapping slot 312 moves to the position to snappingly engage with the snapping rib 181. In the mean time, the conductive blade 32 moves downward to contact and insert between the gap of the two conductive blade clamps 26 and 27, such that the positive pole forms a closed circuit to connect with the power supply.

The present invention makes use of a control switch to move longitudinally in the body to render the conductive blade selectively contact with or separate from the two conductive blade clamps to control the connection/disconnection of the power supply, providing a stable mechanical structure for controlling power supply. Also, the present invention does not use a unitary control switch and thus the material cost can be greatly reduced and a competitive product can therefore be obtained. Furthermore, a display device is arranged in the present invention. When the light is on, the power is in a closed circuit condition; on the other hand, the power is in an open circuit condition when the light is off. Finally, the mechanical structure of the control switch of the present invention can sustain a higher current (higher ampere) to adequately supply the power required for peripheral devices, and thus the present invention may be applied more widely.

While the invention has been described with reference to the a preferred embodiment thereof, it is to be understood that modifications or variations may be easily made without departing from the spirit of this invention, which is defined by the appended claims.

What is claimed is:

1. A vehicle power plug with a control switch, comprising:

a hollow cylinder body having two mating semi-circular arc covers with one end sealed by an end cap and the other end socketedly connected to a seal cap, a snappingly engaged structure disposed therein, and a through line hole at an appropriate position running through its top and bottom;

an electrode set disposed inside the body having a positive role and at least two negative poles which are axially and radially disposed, respectively, and protrude from a cover hole of the end cap and at least two opposite slots on the body, respectively, and two conductive blade clamps separately arranged on each of two sides of the snappingly engaged structure, one blade clamp being coupled with the positive pole and the other blade clamp and the negative poles being coupled with a power cord, respectively, and the power cord being extended out of the body through line holes; and a control switch having a press rod axially connected with a conductive blade, and the press rod connected with the snappingly engaged structure is machined to form a two-step locating structure with its one end of two opposite ends extending out of the body through a button hole;

wherein the press rod extending out of the button hole of the body is applied with a force on the one end extending out of the body and the locating structure longitudinally displaces in the snappingly engaged structure of the body to be selectively located, so as to render the conductive blade contact with or separate from the two conductive blade clamps and thus to control the connection or disconnection with a power supply.

2. The vehicle power plug according to claim 1, wherein a fuse is disposed between the positive pole and a positive lead, the positive lead is encompassingly connected within a spring and the rear side of the positive lead extends over a partition rib to couple with the one conductive blade clamp.

3. The vehicle power plug according to claim 1, wherein the snappingly engaged structure comprises a pair of clamp tenon protrudingly disposed in the body and a pair of snapping rib protrudingly provided in the inner surface of the body corresponding to the clamp tenons, and the locating structure comprises two snapping slots longitudinally formed in the middle section of the press rod so as to render the two snapping ribs selectively snappingly engaged with the snapping slots by the longitudinally displacement of the press rod.

4. The vehicle power plug according to claim 1, wherein the positive pole and the negative pole are coupled with a display device to display the power status.

5. The vehicle power plug according to claim 1, wherein the display device is a light emitting diode (LED).

6. The vehicle power plug according to claim 1, wherein the press rod is machined to form a plate slot on the middle to socketingly connect with the conductive blade.

7. The vehicle power plug according to claim 1, wherein the end cap is a lens.

8. The vehicle power according to claim 1, wherein each arc cover is provided with an indented screw segment and two clamp edges on its respective end, such that the two covers may be screwed together by the end cap with an internal screw segment and socketingly connected with the seal cap whose circumference provided with a protruding ring.

9. The vehicle power plug according to claim 1, wherein the two conductive blade clamps are a shape of X with a gap between them.

* * * * *